US008003869B1

(12) United States Patent
Rudy

(10) Patent No.: US 8,003,869 B1
(45) Date of Patent: Aug. 23, 2011

(54) HARMONICS

(76) Inventor: Christopher John Rudy, Fort Gratiot, MI (US)

( * ) Notice: Subject to any disclaimer, the term of this patent is extended or adjusted under 35 U.S.C. 154(b) by 0 days.

(21) Appl. No.: 12/382,364

(22) Filed: Mar. 13, 2009

Related U.S. Application Data

(60) Provisional application No. 61/069,479, filed on Mar. 15, 2008, provisional application No. 61/197,094, filed on Oct. 23, 2008.

(51) Int. Cl.
*G10D 3/16* (2006.01)

(52) U.S. Cl. ..... 84/320

(58) Field of Classification Search ..... 84/267, 84/320–322, 315–317
See application file for complete search history.

(56) References Cited

U.S. PATENT DOCUMENTS

| | | | | |
|---|---|---|---|---|
| 1,885,843 | A * | 11/1932 | Langer | 84/322 |
| 7,179,976 | B2 * | 2/2007 | West | 84/322 |
| 2003/0094087 | A1 * | 5/2003 | Gregory | 84/267 |
| 2008/0022837 | A1 * | 1/2008 | Rubens | 84/322 |

OTHER PUBLICATIONS

Sandercoe, Justin, www.youtube.com, TE-011 Classical Harmonics Guitar Lesson (justinguitar.com), Feb. 18, 2007, screen print 2:07/4:07 and print out 2:41/4:07 with Text Comments Page 1 of 1, downloaded Mar. 18, 2010.

Sandercoe, Justin, www.youtube.com, TE-014 Harp Harmonics (Guitar Lesson), May 17, 2009, screen prints 0:18/9:10; 3:16/9:10; 3:20/9:10 and 4:34/9:10, downloaded Mar. 18, 2010.

Sandercoe, Justin, www.youtube.com, TE-012 Pinch Harmonics (Squealies) Guitar Lesson, Feb. 19, 2007, printout with Text Comments, 1 page, downloaded Mar. 18, 2010.

Sandercoe, Justin, www.youtube.com, TE-013 Topped Harmonics Guitar Lesson, Feb. 18, 2007, printout with Text Comments, 1 page, downloaded Mar. 18, 2010.

Earl Scruggs and the 5-String Banjo, Peer International Corporation, New York, NY, 1968, pp. 68-70; and Hal-Leonard Corporation, Milwaukee, WI, 2005, pp. 67-68 both by Earl Scruggs, illustrated by Burt Brent, M.D.

Weruick, Peter, Bluegrass Banjo, Oak Publications, New York, NY, 1974, pp. 56-57.

Davis, Janet, Mel Bay's Back-up Banjo, Mel Bay Publications Inc., Pacific, MO, 1981, part of page styled, "Barre" Position Licks.

Trischka, Tony, Banjo Song Book, Oak Publications, New York, NY, 1977, p. 17.

Banjo Hangout, www.banjohangout.org, The Secret to Playing Chimes, postings from Oct. 11, 2007 to Oct. 12, 2007, downloaded Feb. 1, 2008.

Banjo Hangout, www.banjohangout.org, Chimes, postings from Dec. 16, 2008 to Dec. 17, 2008, downloaded Feb. 1, 2008.

Wikipedia, the free encyclopedia, Thumb Position, Oct. 11, 2008, downloaded Mar. 10, 2009.

Hultgren, Craig, lunanova.org, Extended Techniques for Cello, Harmonics, downloaded Mar. 10, 2009 (5 pp.).

Alice Reed of Fort Gratiot, MI demonstrates harmonic technique on violin, two photo printouts, Mar. 10, 2009 A.D.

"Banjophobic," LOTW poll (Lick of the Week Poll), posting and reply concerning harmonics, www.banjohangout.org/topic/196495, Jan. 13, 2011.

* cited by examiner

*Primary Examiner* — Kimberly Lockett

(57) ABSTRACT

A harmonic chime on a stringed instrument can be rendered by touching a part of a stringed instrument player's body, which is not part of a first member of the player's body that shortens a playable length of a string, to the string along its playable length at a harmonic-rendering position of the string, and plucking the string within its playable length to provide a harmonic chime on the string. Such a technique can provide for natural or artificial harmonic tones.

20 Claims, 12 Drawing Sheets

Figures 1, 2:
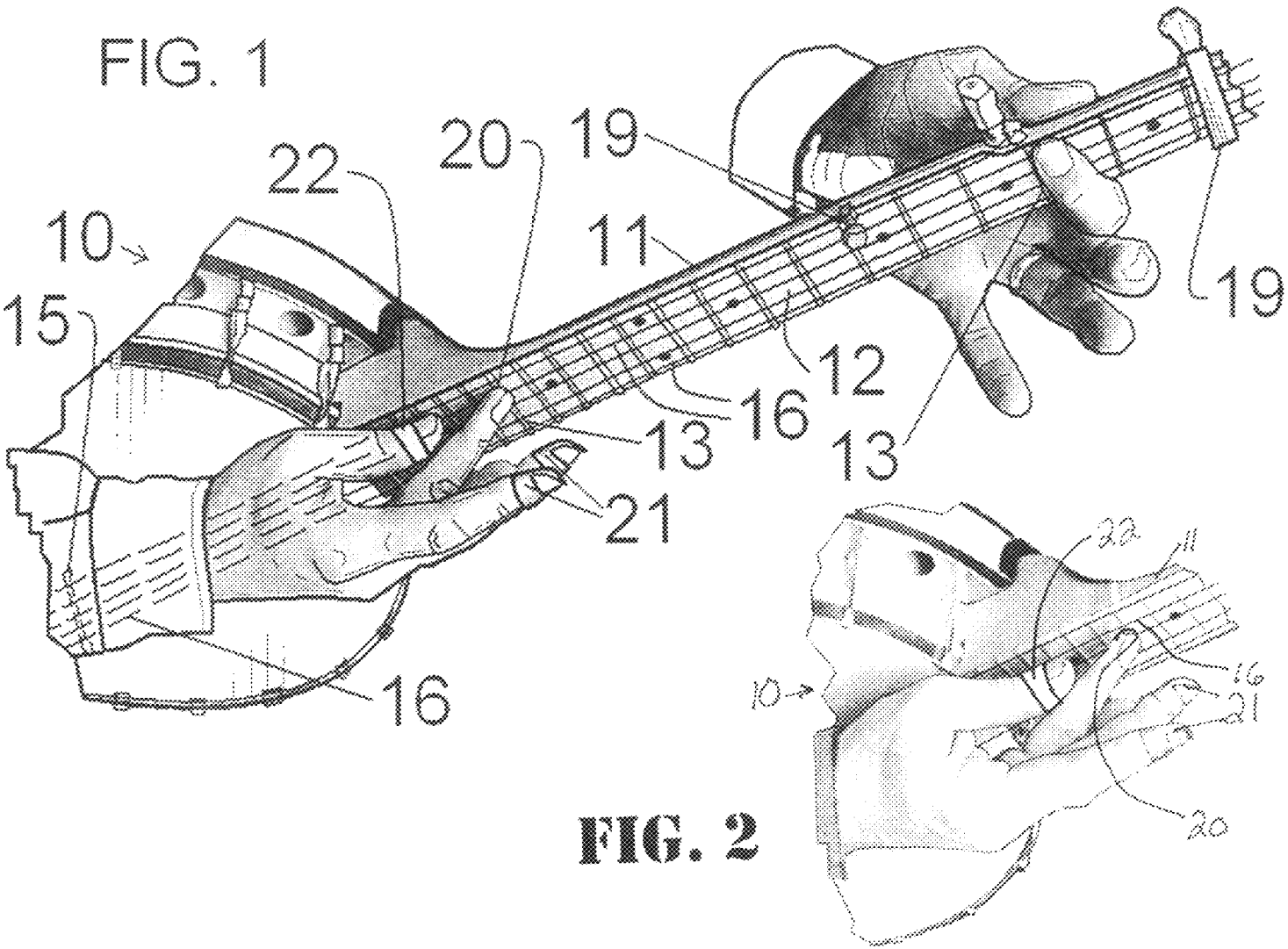

FIG. 4
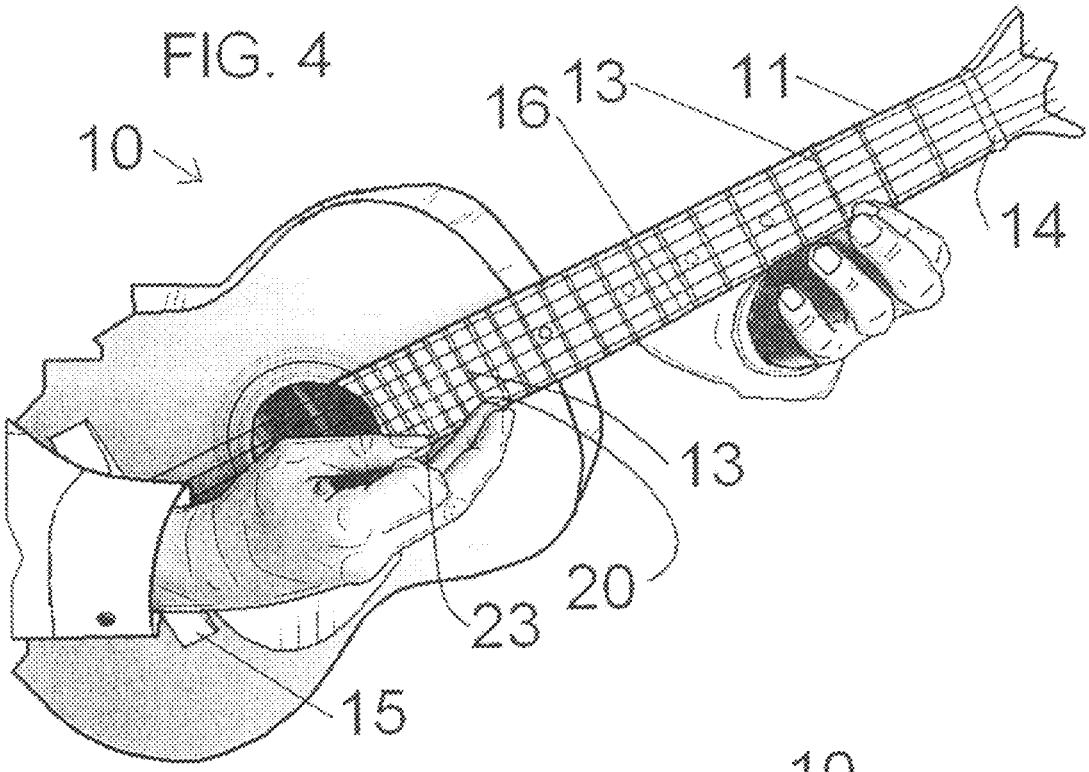
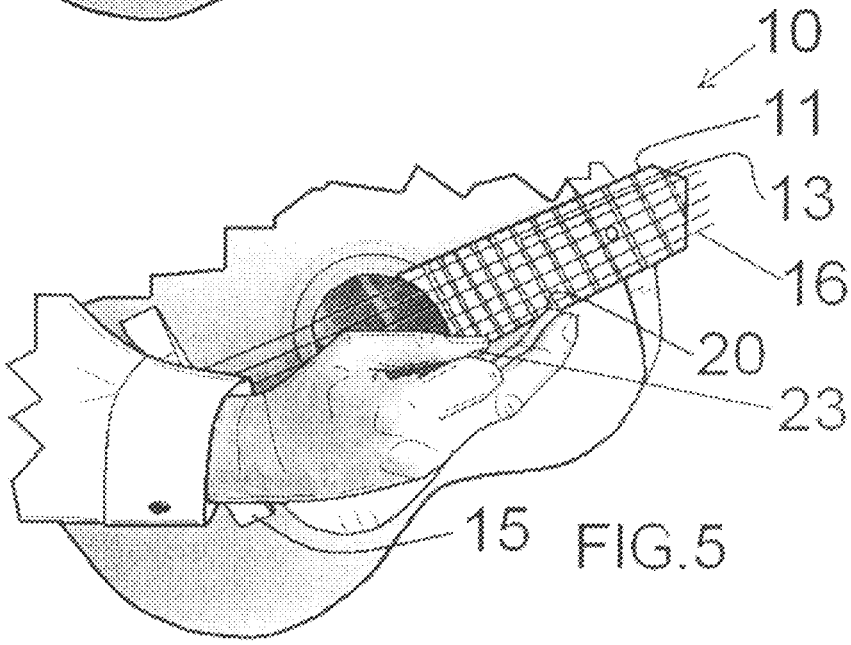
FIG.5

HARMONICS

This claims the benefits under 35 USC 119(e) of provisional patent application Nos. US 61/069,479 filed on Mar. 15, 2008 A.D., and US 61/197,094 filed on Oct. 23, 2008 A.D. The complete specifications of both of those applications to include their drawings are incorporated herein by reference.

FIELD OF THE INVENTION

This concerns rendering harmonics on a stringed instrument, especially plucked.

BACKGROUND TO THE INVENTION

Harmonics, which also are known as "chimes," are a popular special effect played on certain stringed instruments, for example, banjos, and sometimes guitars, mandolins, and so on. The notes available from common prior art chiming, however, are noticeably limited. On fretted instruments, they are commonly known to be played on open strings by lightly touching the string at the fifth, seventh, twelfth, seventeenth or nineteenth fret position with a finger of the "fretting" hand, and plucking the string with the "picking" hand by a finger or thumb, nail or pick. The finger of the fretting hand may be lifted as the string is plucked to allow the ring of the chime to be sustained longer. That harmonic chime at the twelfth fret rings at an octave above the pitch of its open string and has a node at the twelfth fret location, which is half way between the nut and the bridge, to divide the string into two even segments; at the fifth or seventeenth fret, two octaves above the open string, where nodes are formed from a division of the string into four even segments; and at the seventh or nineteenth fret rings, "so," an octave higher than the fifth note in the common major scale from the open string, where nodes are formed from a division of the string into three even segments. Thus, if a string were tuned to G, the twelfth fret harmonic chime for that string would be heard as G one octave higher than the open note; the fifth or seventeenth fret harmonic chime would be heard as G two octaves higher than the open note; and the seventh or nineteenth fret harmonic chime would be heard as a D-note higher in pitch than the twelfth fret harmonic but lower in pitch than the fifth or seventeenth fret harmonic. Other harmonics can be found at other positions, one notable example being the fourth or ninth fret positions, for example, which for an open G-string would ring as a high B-note, where nodes are located from division of the string into five segments, although fainter than the aforementioned. Although in theory harmonics can be sounded at other positions, they are usually too faint or high in tone to be effectively played or heard. Harmonics on open strings, i.e., a string that has its full length from the nut of the instrument to its bridge, are termed, "natural harmonics."

A 5-string banjo is commonly tuned to an open G-tuning (gDGBD). Thus, the harmonics played at the fifth and twelfth frets are from notes of a G-chord (I-chord), and the chimes played at the seventh fret are from notes of a D-chord (V-chord). If a banjo player wished to play harmonics, he thus would generally be limited to playing the notes, G, A, B, D, F# and G. He also could chime a high D# in that G-tuning by playing a chime on the second string, fourth fret position. In back-up or solo work in the standard G-tuning, the banjo player can play chimes effectively while a G-chord or D-chord is playing. These are natural harmonics. However, many if not most songs also employ the IV-chord, which in a song played in the key of G is a C-chord. In common G-tuning on the banjo, many notes from the C-chord are inaccessible through known chiming for that instrument, for example, C-, E- and F-notes.

Guitars in standard tuning are tuned E, A, D, G, B, E, which does not make a major chord (whereas resophonic guitars commonly are tuned to an open G, sometimes an open D, E or E7). With a guitar in standard tuning, natural harmonics at the fifth and seventh fret positions are useful to tune the strings by fifths and octaves, but may not employed as frequently in performance as done with the 5-string banjo.

Mandolins, which have double strings, are commonly tuned in sevenths, like violins, i.e., G, D, A, E, which again does not make a major chord. Natural harmonics can be used to tune the mandolin, but, as with guitars, are not often used in performance.

It is known in certain stringed instruments, at least with such instruments as violins, violas, cellos and double basses, to make not only natural harmonics but also to make in a limited fashion what are termed, "artificial harmonics." The latter are formed on a point on a string stopped by a finger. These are normally known to be executed, for example, on the violin and viola by solidly stopping the string on the fingerboard with the index finger and lightly touching the node a perfect fourth higher with the little finger. This produces a harmonic pitch two octaves higher than the stopped pitch of the string. Because of their longer string lengths, the cello and double bass typically require the thumb to stop the string and the ring finger to excite the harmonic. The string length on the double bass is so long that the perfect fourth can only be reached in the higher positions of the fingerboard. Different artificial harmonics are known to be produced by thus touching a perfect fifth above the stopped pitch and a major third above the stopped pitch. The major third harmonic is more often employed on the double bass because of its shorter length from the stopped string. Slides between pitches, i.e., glissandos, are known to work well with artificial harmonics, for example, in cello music. There the exciting finger may be moved along the string in relation to the stopped finger to keep the appropriate interval for the desired tone, or not moved to obtain certain effects. The instrument is understood to be bowed during the slide to sustain the glissando sound.

A FULL DISCLOSURE OF THE INVENTION

In general, provided is a method for playing a harmonic chime on a stringed instrument, which comprises touching a part of a stringed instrument player's body, which is not part of a first member of the player's body that shortens a playable length of a string, to the string along its playable length at a harmonic-rendering position of the string, and plucking the string within its playable length to provide a harmonic chime on the string. Such a technique can provide for natural or artificial harmonic tones. The artificial harmonic tones can be provided by shortening a playable length of a string of the stringed instrument by forcing the string into contact with a fingerboard by part of a first member of a stringed instrument player's body, and, touching another part of the player's body, which is not part of a first member of the player's body, to the string along its playable length at a harmonic-rendering position of the string, plucking the string with the a part of the other part of the first member of the player's body, within its playable length to provide a harmonic chime on the string while so shortened. Thus, a harmonic chime is provided, performed live or recorded; or instruction in person or in a tangible medium of expression to perform such a harmonic chime can be provided.

The invention is useful in music.

Significantly, by the invention, the art is advanced in kind. Hereby, the notes playable by harmonic chiming are no longer as severely limited as before. Rather, the entire scale from "do" to "do" for two octaves is freed up to be harmonically chimed, with even more range possible. Notes of the entire chromatic scale within that range can be harmonically chimed. Thus, fretted stringed instruments, for example, banjos, guitars and mandolins, and their unfretted or slide-note activating cousins, for example, fretless banjos, slide or resophonic guitars, steel pedal guitars, violins, upright basses, and so forth, now have an extremely full range of harmonic notes made available. And so now, for example, banjo players are not limited in standard G-tuning to playing harmonics only from the chords of G and D and perhaps B, since chimes of the notes C, E and F are available as well as the lower D# note, and A#, C#, G# and so forth. For example, a descending A#, G, E, D run can now be rendered in harmonics on a 5-string banjo in standard G-tuning, say, on the third string (A#, G) and then fourth string (E, D), or all on the fourth string; and an ascending B, C, C#, D run can be rendered in harmonics on the second, third or fourth string, and so forth. Now banjo, guitar, mandolin and other stringed instrument players can render chimed solos or back up in nearly any if not every scale. In short now, within limits of the tuning and neck of an instrument, many, many notes can be chimed cleanly, and the melody or harmony line for an entire song can be rendered in harmonic chimes, which includes those notes not found on the predominant chime-making positions, the twelfth, fifth and seventeenth, and seventh and nineteenth frets, or even at the less used more faint fourth fret. Moreover, chimed notes made up the scale from the nut on the fingerboard can be "bent" or "choked," subject to "vibrato" choking, and even "slid" up or down scale with a smooth slide device, or with a finger on the fingerboard of a fretless instrument, while retaining a chimed sound that increases and/or decreases in pitch, which is especially clear when carried out with the slide device. Also, strings chimed anywhere can be stretched or relaxed through pulling or pushing on the neck in relation to the pot or body of the instrument, activating a tuning peg or cam such as a standard tuning peg or a Scruggs' tuner or Scruggs-Keith tuner, or activating a string-controlling pedal or lever as on a steel pedal guitar or an electric guitar equipped with such, while retaining a chimed sound that increases or decreases in pitch with the tightening or loosening of the string that is chimed. Practice of the invention, within the limits of size and dexterity of the player's body, of course, can be carried out effectively if not efficiently. Thus, natural and artificial harmonics can be rendered, and these can be rendered most readily on the ½ segment node (a perfect half) of a string, open or stopped.

Numerous further advantages attend the invention.

The drawings form part of the specification hereof. With respect to the drawings, which are not necessarily drawn to scale, the following is noted:

FIG. 1 is a view of a right-handed 5-string banjo, with the banjo tuned in standard G-tuning (gDGBD) and capoed up two frets to the key of A (aEAC#E), and a banjo player ready to chime a harmonic lower F#-note that will ring one octave above the unfretted lower F#-note by fretting the fourth string with any convenient finger of his fretting hand, for example, the index, at the second fret in front of the capo and touching the string lightly with an outstretched finger of his picking hand, for example, the fourth (ring) finger at the fourteenth fret position in front of the capo, i.e., twelve frets above the stopped (here, fretted) second fret, i.e., a perfect half of the stopped string, considering that the capo forms a new "nut," which, if not stopped at a point along the string, defines the new open string. Since the string is fretted, the harmonic will be considered an artificial harmonic. The ring finger is employed here because it does not have a pick on it since the player is playing in a 3-finger style with a thumb pick and two finger picks, one finger pick on each of his index and middle (long) fingers, although another finger than the ring finger, with or without a pick, could be employed on the picking hand to touch the string at a harmonic-rendering location with respect to the fretted location. Simultaneously, the picking hand thumb, here, through its pick, which is a distance away from the harmonic-rendering location, and closer to the bridge, is made ready to pick the fourth string.

FIG. 2 is a view of the banjo of FIG. 1, showing detail of the picking hand as it has picked the fourth string with the thumb and lifted the ring finger upon picking the string. The F# artificial harmonic chime one octave above the lower F# note rings. Sounding a harmonic chime in this fashion is quite easy, and can be carried out on a string that is open or fretted or otherwise stopped at any position, for rendering natural or artificial harmonics, respectively. Making the harmonic in this fashion is very certain to render a clear, true harmonic chime. Also, the fretting and picking hands can move readily to the next position to render there a harmonic in the same fashion or a standard picked sound.

Figure 3:
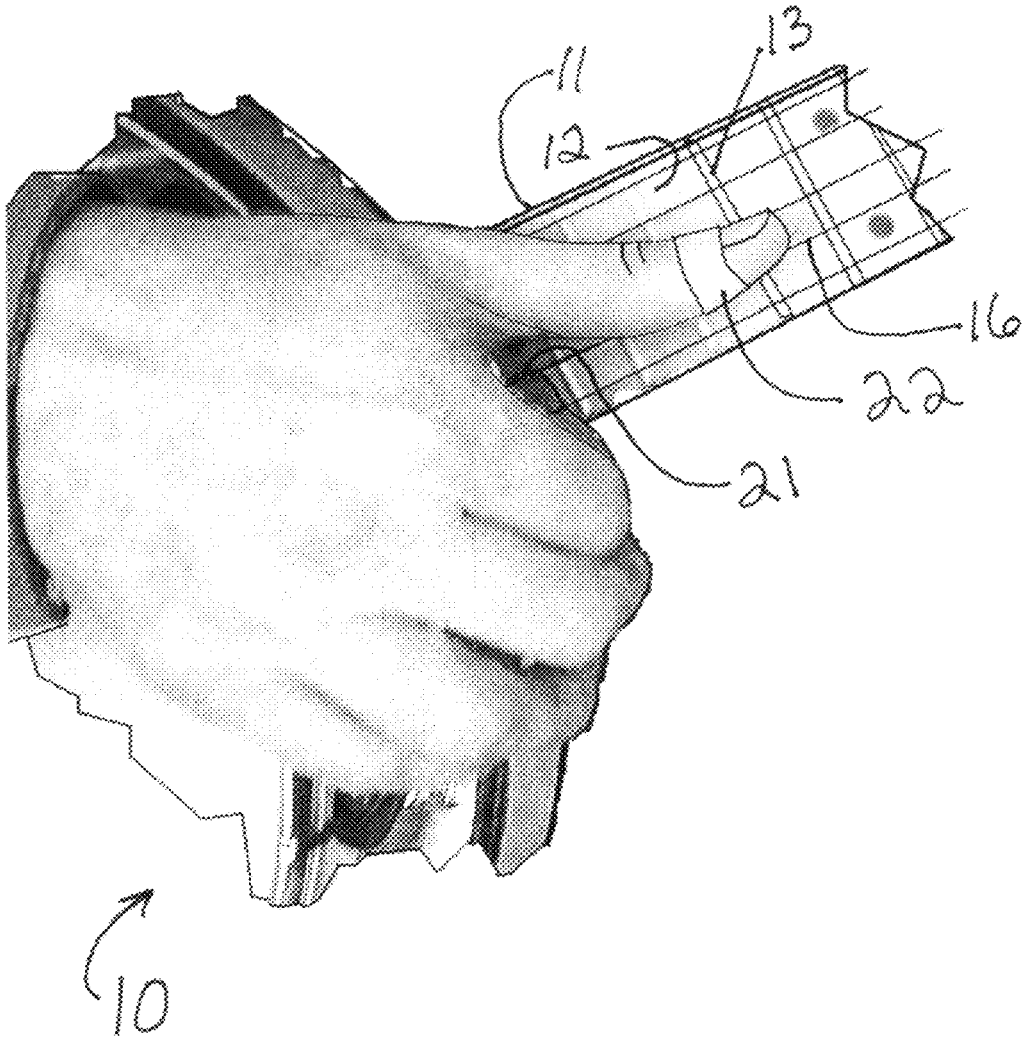

FIG. 3 is a view of the banjo of FIG. 1, not capoed and in standard G-tuning, and the banjo player ready to strike a harmonic chime of a C-note made on the second string, which here will ring one octave higher than the note at the fretted location. The string is fretted at the first fret with the fretting hand. Thus, the harmonic here is an artificial harmonic. Here, the thumb pick of the fretting hand touches the string lightly at the thirteenth fret, i.e., twelve frets above the fretted location, and the index finger pick is picked up to sound the note, with the thumb pick being released from the string upon picking the string. This also is an easy way to render a harmonic chime, but, since the location, softness and touch of the thumb pick against the string is not as easy to discern as that with a bare finger, it may be less desirable than FIGS. 1 and 2.

FIG. 4 is a view of a guitar, with the guitar tuned in standard tuning (EADGBE), and a guitar player holding a flat pick between this thumb and index finger and ready to chime a harmonic G-note that will ring one octave above the fretted G-note on the first string. Here, the first string is fretted with any convenient finger of his fretting hand, for example, the index, at the third fret, and, up the neck, the string is touched lightly with an outstretched finger of his picking hand, for example, the ring finger, at the fifteenth fret. Another finger than the ring finger, say, the middle finger, could be employed on the picking hand to touch the string at a harmonic-rendering location with respect to the fretted location, which location is at an integral node of a segment of the string that can ring ahead of the nut or ahead of the stopped position. Simultaneously, the pick, which is a distance away from the harmonic-rendering location, closer to the bridge, is made ready to pick the first string. Compare, FIG. 1.

FIG. 5 is a view of the guitar of FIG. 4, showing detail of the picking hand as it has picked the first string with the pick and lifted the ring finger upon picking the string. The G harmonic chime one octave above the fretted G-note rings. Making the harmonic in this fashion is very certain to render a clear, true harmonic chime. Also, the fretting and picking hands can move readily to the next position to render there a harmonic in the same fashion or a standard picked sound.

Figure 6:
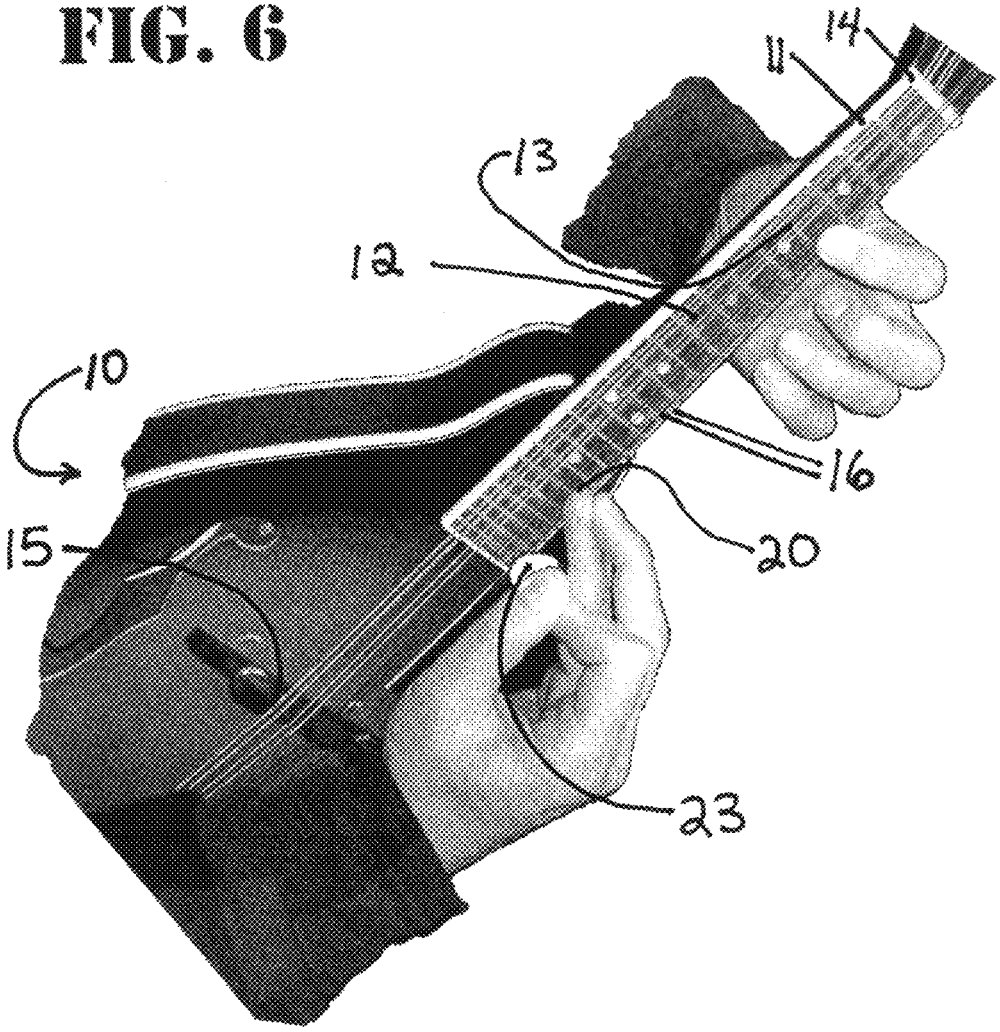

FIG. 6 is a view of a mandolin in standard tuning (GDAE), and a mandolin player holding a flat pick between his thumb and index finger and ready to chime a harmonic G#-note that will ring one octave above the fretted G#-note on the first string or first set of double strings. This will be considered an artificial harmonic because the first string set is fretted, here, with any convenient finger of his fretting hand, for example, the index, at the fourth fret, and, up the neck, the string set is touched lightly with an outstretched finger of his picking hand, for example, the ring finger, at the sixteenth fret. The ring finger may lie slightly on its side across both first strings. Similar to that noted above, another finger than the ring finger, say, the middle finger, could be employed on the picking hand to touch the string at a harmonic-rendering location with respect to the fretted location, depending on preference or necessity. Simultaneously, the pick, which is a distance away from the harmonic-rendering location, closer to the bridge, is made ready to pick one or both of the first set of double strings, say, by concisely plucking one string only or by dragging the pick across the double set. Compare, FIGS. 1 and 4.

Figure 7:
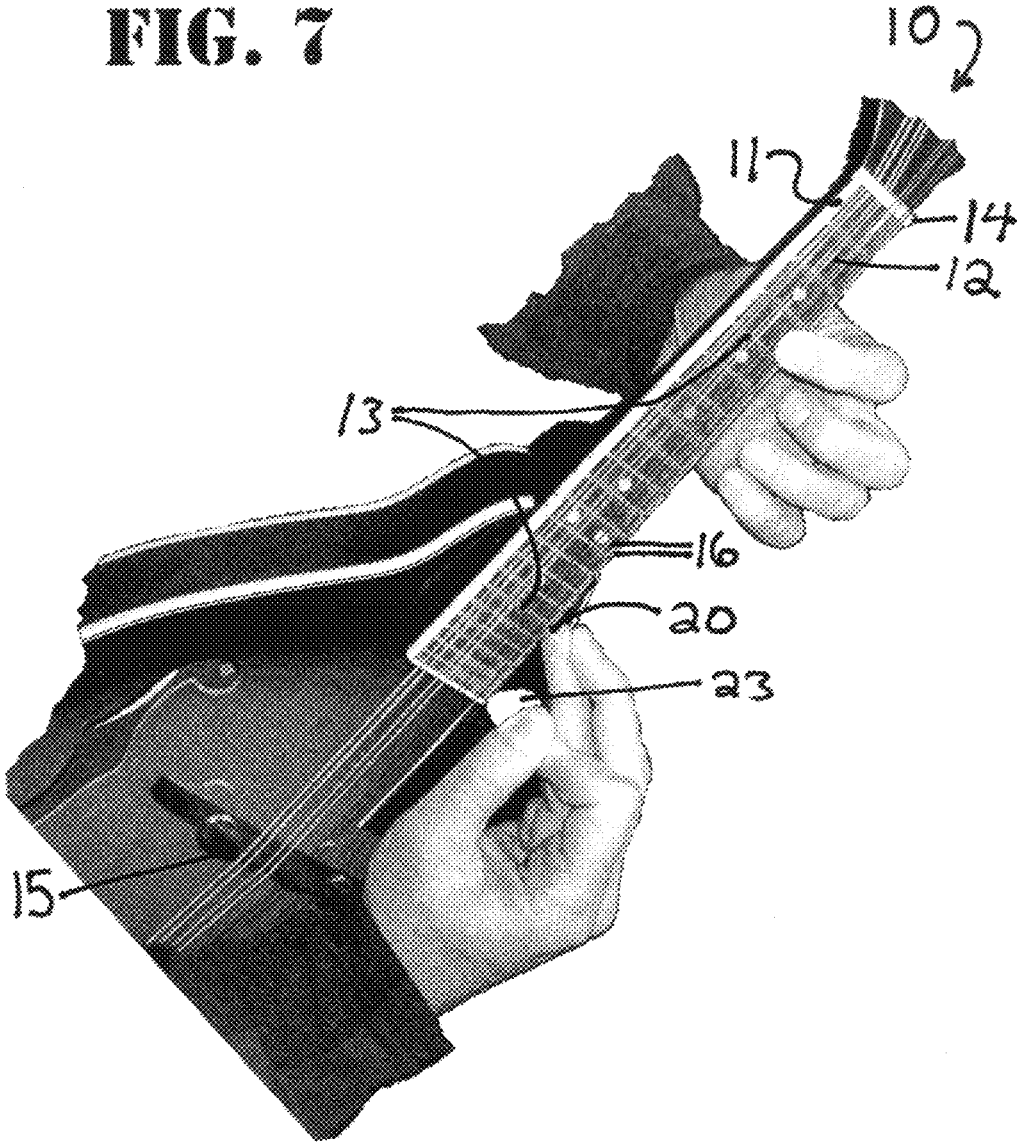

FIG. 7 is a view of the mandolin of FIG. 6, showing detail of the picking hand as it has picked the first double string with the pick and lifted the ring finger upon picking both of the strings of the double set. The G# harmonic chime one octave above the fretted G#-note rings. Making the harmonic in this fashion is very certain to render a clear, true harmonic chime. Also, the fretting and picking hands can move readily to the next position to render there a harmonic in the same fashion or a standard picked sound.

Figure 8:
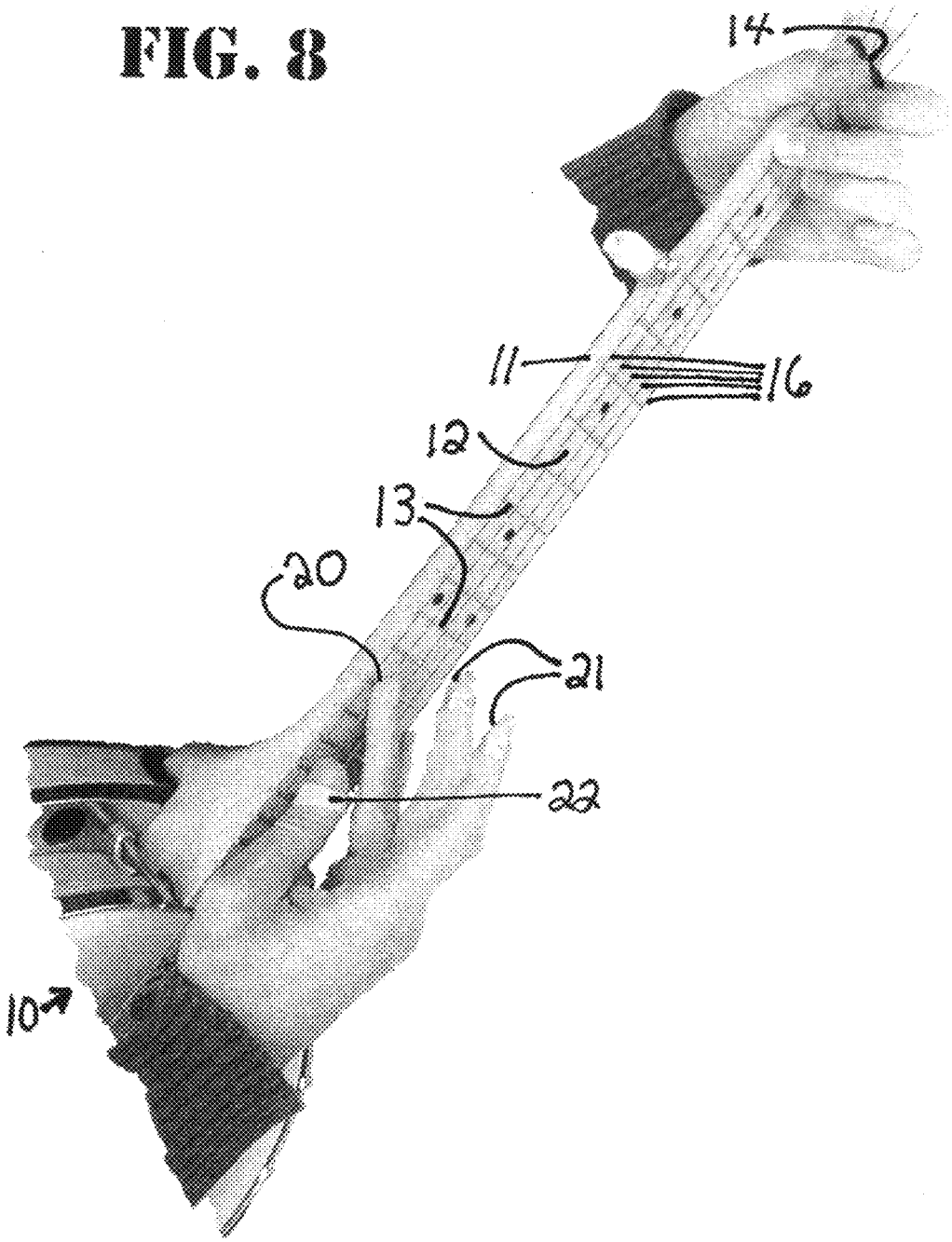

FIG. 8 is a view of the banjo of FIG. 1, not capoed and in standard G-tuning, and the banjo player ready to render harmonics at the half-segment positions of the strings one at a time in succession as he holds a C-chord near the nut, each string excited according to the principles as, for example, described with respect to FIGS. 1 and 2. Thus, if the harmonics are rendered so, say, over the first four strings beginning with the fourth and ending with the first, a C-chord inversion (EGCE) is sounded in harmonics one octave higher than the fretted or open notes of the strings in arpeggio fashion.

Figure 9:
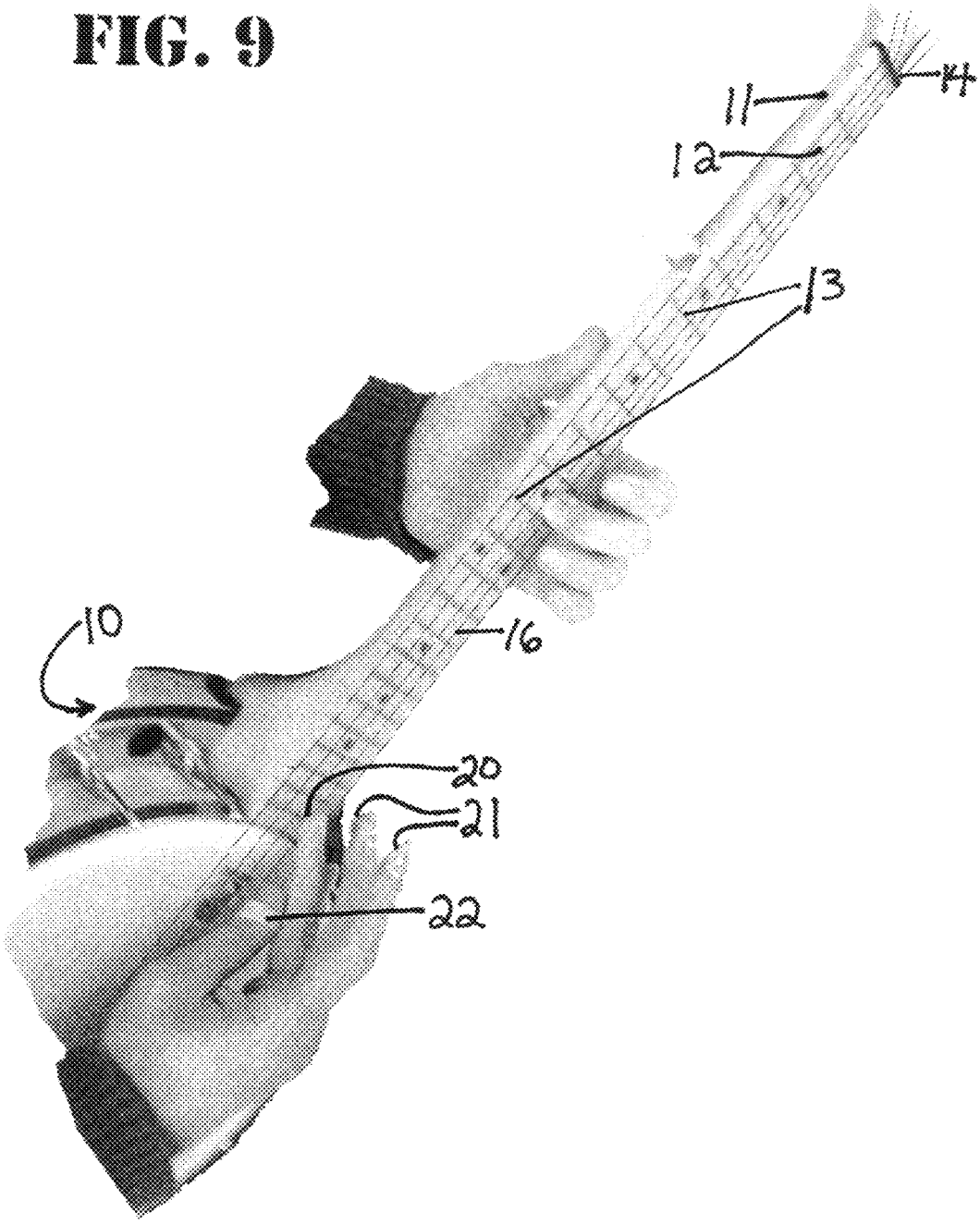

FIG. 9 is a view of the banjo of FIG. 1, not capoed and in standard G-tuning, and the banjo player ready to render a harmonic at a half-segment position of the second string fretted at the tenth fret and ready to be choked. The string is ready to be excited according to the principles as, for example, described with respect to FIGS. 1 and 2. Thus, the resulting perfect half artificial harmonic initially will be at an A-pitch, one octave above the pitch for that string fretted at the tenth fret.

Figure 10:
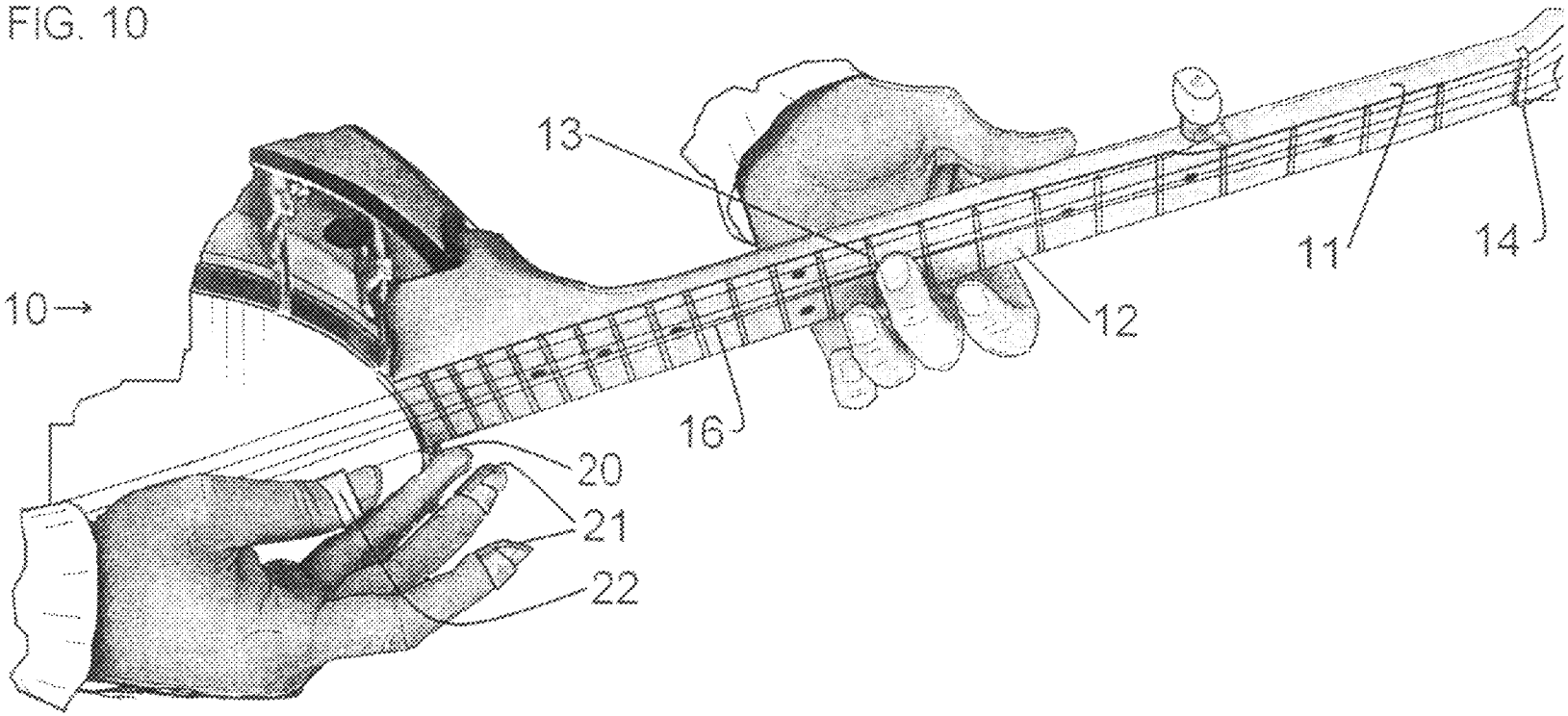

FIG. 10 is a view of the banjo of FIG. 10, showing details of the picking hand as it has picked the second string with the thumb and lifted the ring finger upon picking the string as, for example, described with respect to FIGS. 1 and 2, and of the fretting hand as it is choking the string as or after the harmonic has been rendered. With choking, the pitch of the harmonic chime is raised in a slur, and noticeably sounds as a harmonic. The choked string can be released during the ringing of the chime to lower the pitch in a slur, which, too, sounds as a harmonic.

Figure 11:
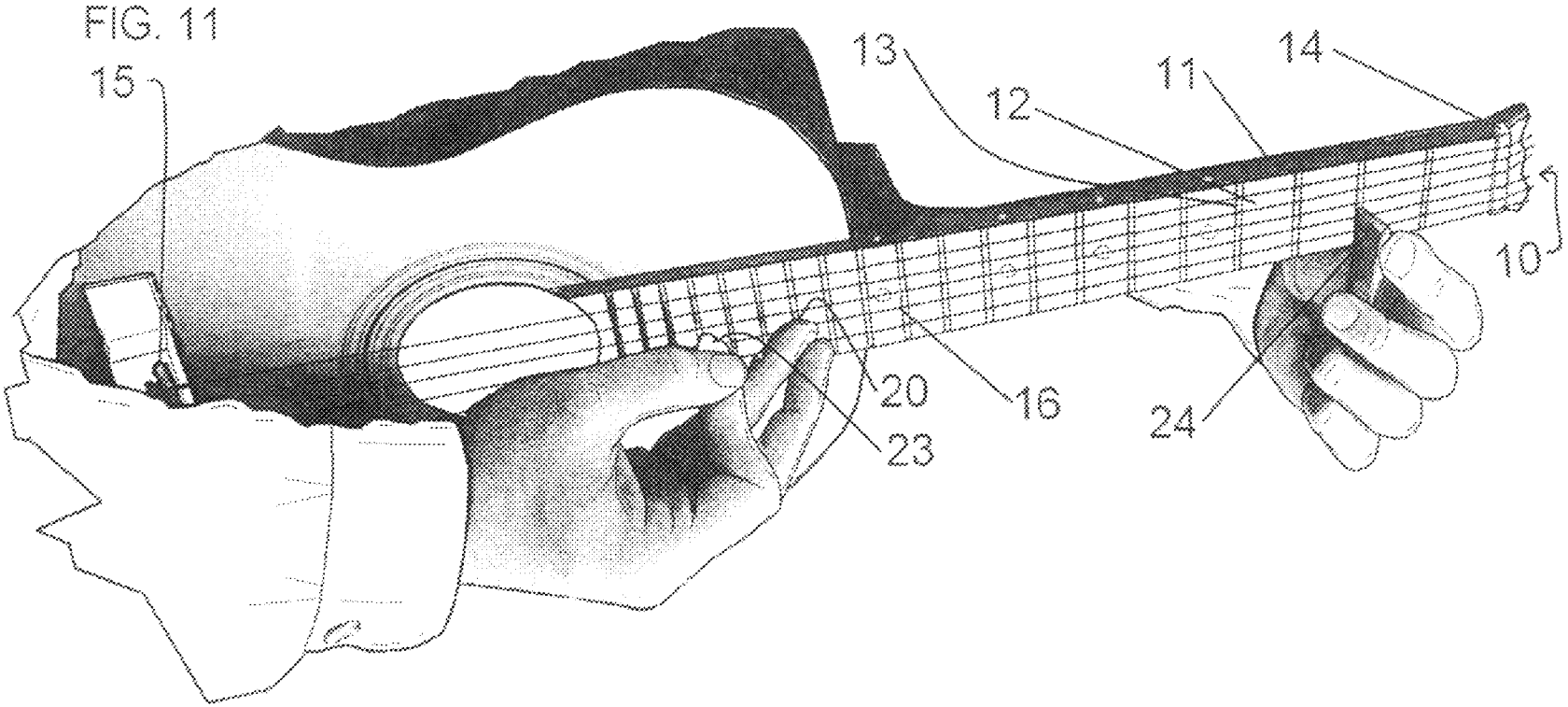

FIG. 11 is a view of the guitar of FIG. 4, with the guitar tuned in standard tuning (EADGBE), and a guitar player holding a flat pick between his thumb and index finger and ready to chime an initial artificial harmonic A-note that will ring one octave above the A-note on the third string, which is stopped above the second fret with a smooth slide device. The slide device is ready to be slid, for example, up the string. It may be held in place otherwise, or slid down toward the nut. Here, too, the third string is touched lightly with an outstretched finger of the player's picking hand, for example, the ring finger, at the fourteenth fret so as to sound the initial A-note chime. Simultaneously, the pick, which is a distance away from the harmonic-rendering location, closer to the bridge, is made ready to pick the string. Compare, FIGS. 1 and 4.

Figure 12:
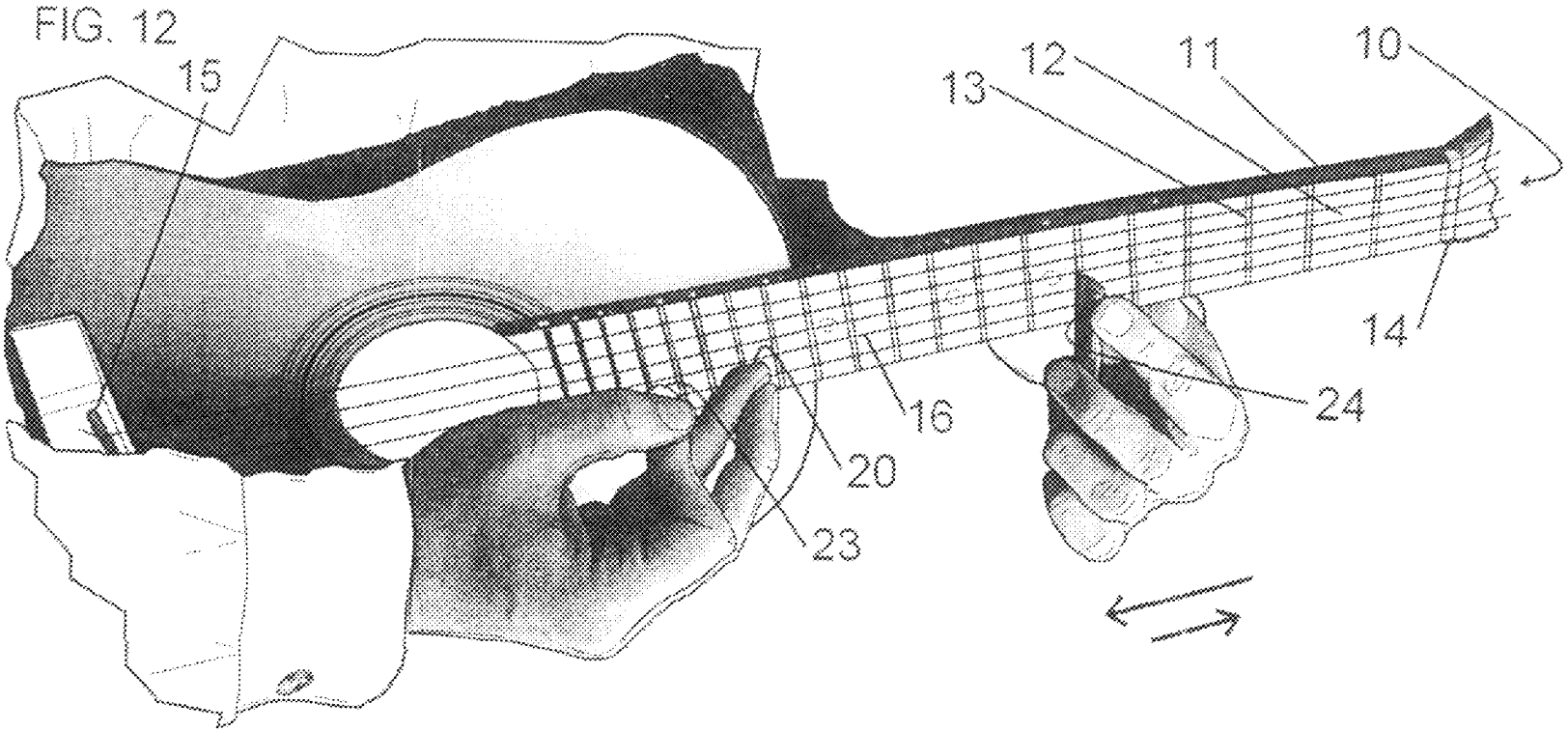

FIG. 12 is a view of the guitar of FIG. 11, after the initial artificial harmonic chime has been rendered as an A-note, and slid upward to the sixth fret, which renders a clear, self-sustaining harmonic slide or glissando from the artificial A-note to an artificial C#-note harmonic sounding one octave above the pitch of the sixth fret, third string, if it had been fretted. The C#-note harmonic pitch can be raised in a sliding harmonic tone by sliding up the string further with the slide device touching the string, or lowered in a sliding harmonic tone by sliding down the string toward the nut with the slide device touching the string.

Figure 13:
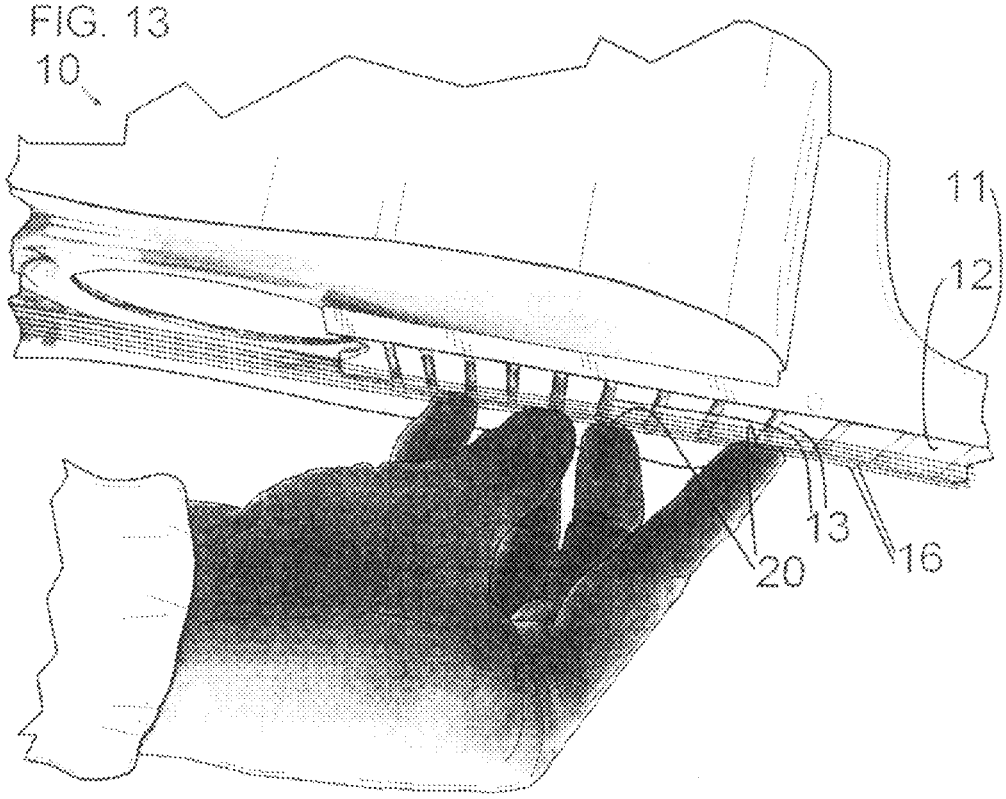

FIG. 13 is a view of the guitar of FIG. 4, with the guitar tuned in standard tuning (EADGBE), and a guitar player picking without picks and ready to render a partial chord of two harmonic chimes, which are sounded simultaneously. Here, the left hand is fretting a G-chord near the nut, i.e., the first and sixth strings are fretted at the third fret position, and the fifth string is fretted at the second fret position, and the right hand has its index finger above the perfect half-string node above the twelfth fret of the second string, and touching the string there ready to help excite a natural harmonic B-note one octave above the open B-string; its middle finger above the perfect half-string node above the fifteenth fret of the first string, which is fretted at the third fret, and touching the string there ready to help excite an artificial harmonic G-note one octave above that fretted string; its thumb ready to pluck the second string perpendicularly toward the first string at a position between the node upon which the first finger rests and the bridge; and its little finger ready to pluck the first string perpendicularly toward the second string at a position between the node upon which the second finger rests and the bridge, at the same time that the thumb plucks the second string. In other words, the thumb and little finger make a pinch while the first and second fingers rest upon their respective node positions. For a longer sustaining harmonic chime partial chord, as soon as the pinch is made, the first and second fingers are lifted from their positions on their respective strings.

Figure 14:
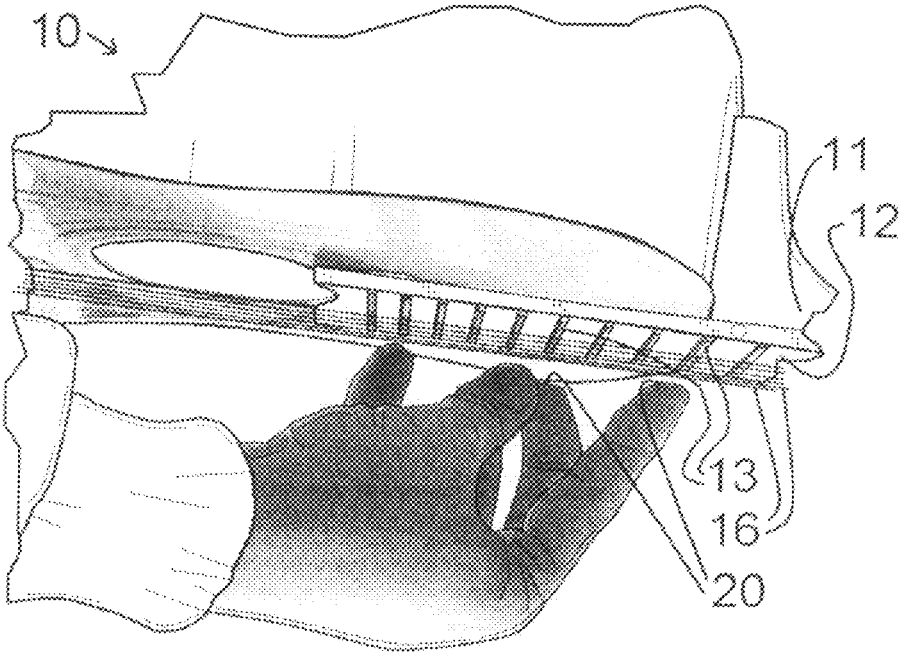

FIG. 14 is a view of the guitar of FIG. 13, showing details of the picking hand as it has made the pinch, excited the partial chord in harmonic B- and G-tones, and lifted up.

The invention can be further understood by the detail set forth below. As with the foregoing disclosure, the following additional disclosure, which may be read in view of the drawings, should be taken in an illustrative and not necessarily limiting sense.

With further reference to the drawings, stringed instrument 10 includes neck 11 and fingerboard 12 that may have frets 13; nut 14; bridge 15; and strings 16. Capo 19 may be employed behind a fret 13 to effectively rendering it into another nut or zeroeth fret in relation to it and the bridge 15. A musician may employ a fleshy pad of the finger tip 20 against a string 16 at a harmonic-rendering location, and may employ finger picks 21 and a thumb pick 22, or may hold a flat pick 23 between his thumb and index finger. He may employ a slide device 24 to render a self-sustaining glissando in harmonic tones, which can be of fairly long duration.

Let's say, for example, that a musician equipped with finger picks 21 and a thumb pick 22 on his right hand wants to render in harmonics a descending C, A, F#, E run, for purposes of illustration, on a 5-string banjo in standard G-tuning, with a capo 19 behind a fret 13 between the nut 14 and bridge 15 so that the instrument is tuned in A (aEAC#E) and the harmonic chime is the dominant chime, i.e., one octave higher than the note on the string. Recalling the technique accompanying FIGS. 1 and 2, for example, with a finger from his left hand, the musician frets the third string behind the third fret above the capo 19 (not counting the "zeroeth" fret) to otherwise fret a C-note. With his right hand, he touches the fretted third string lightly with his outstretched ring finger tip 20 at the fifteenth fret position in front of the capo, and makes his picking hand thumb, through its pick, which is a distance away from the primary harmonic-rendering location at the fifteenth fret position, and closer to the bridge, ready to pick the fretted, lightly touched third string. He then picks the third string with the thumb pick and lifts his right hand ring finger from touching the third string, upon picking the string with his thumb pick. The C harmonic chime one octave above the fretted C-note rings. The next note in the harmonic run, A, can be chimed with the third string open in the standard way by touching the open string with a finger of the left hand at the fourteenth fret location, i.e., twelfth fret location above the capo 19, or, more efficiently for the run, by using the method of FIGS. 1 and 2 employing the right hand ring finger tip 20 to touch the open third string at the fourteenth fret location, i.e., twelfth fret location above the capo 19, and while plucking the open third string with his thumb pick 22, lifting his right hand ring finger from the string, to sound the A-note as a harmonic one octave higher than the note of the open string. The right hand is in position to sound the next harmonic in the run, the F#-note one octave above the fretted F#-note, which is accomplished by the manner described in relation to and illustrated in detail in FIGS. 1 and 2. The next harmonic chime in the run, one octave above the low E-note, is made analogously to the A-note harmonic on the open third string, but, of course, on the open fourth string. To render the harmonics one octave higher, all that the musician must do is touch the string with his ring finger tip 20 at a position five frets above the fretted or open string, rather than twelve, pick the string with his thumb pick 22 and lift his ring finger from the picked string. To render the harmonics in notes from an E-scale (rather than an A-scale with the capo 19 in place on the second fret with the banjo in standard G-tuning) he would touch the string at the seventh fret above the fretted or open string and pick, and to render the harmonics in fainter notes from a C#-scale he would touch the string at the fourth fret above the fretted or open string and pick. Of course, without the capo 19 in place, the respective harmonic scales would be G, D and B.

Let's say, as another illustration, then, that with the banjo in standard G-tuning (gDGBD) with no capo, an ascending B, C, C#, D is desired to be rendered in harmonics on the second string. With the foregoing in mind, beginning with the open B-note, the harmonics for which advantageously are rendered in the manner set forth with respect to FIGS. 1 and 2, i.e., with the right hand ring finger tip 20 touching the open second string at, say, the twelfth fret position, the string is plucked with the right thumb pick, and the ring finger lifted to allow the primary harmonic chime of B one octave in tone above the open B-note to ring. Next, the third string is fretted with a finger of the left hand behind the first fret to fret a C-note; the right hand ring finger tip 20 is touched to the same string at the thirteenth fret position, i.e., twelve frets above the fretted first fret; the string is plucked with the right thumb pick, and the ring finger is lifted to allow the primary harmonic chime of C one octave above the fretted C-note to ring. Next the third string is fretted with a finger of the left hand behind the second fret to fret a C#-note; the right hand ring finger tip 20 is touched to the same string at the fourteenth fret position, i.e., twelve frets above the fretted second fret; the string is plucked with the right thumb pick, and the ring finger is lifted to allow the primary harmonic chime of C# one octave above the fretted C#-note to ring. Finally, the third string can be fretted with a finger of the left hand behind the third fret to fret a D-note; the right hand ring finger tip 20 can be touched to the same string at the fifteenth fret position, i.e., twelve frets above the fretted third fret; the string is plucked with the right thumb pick, and the ring finger is lifted to allow the primary harmonic chime of D one octave above the fretted D-note to ring. The open first string could be made to chime in the usual manner by touching it with a finger of the left hand at the twelfth fret position and picking with the right hand, or by touching it with the right hand ring finger tip 20 at the twelfth fret position and picking it with the thumb pick 22 while lifting the finger from the string to render the primary D harmonic to complete the run.

The same principles would apply for rendering harmonics on fretted or open strings of instruments picked with a flat pick 23 such as guitars, mandolins, plectrum banjos, etc. Compare, FIGS. 4-7. In the case of a mandolin or other double-stringed instrument such as a 12-string guitar, one or both of a pair of strings may be chimed. Then, too, as may a banjo, a guitar may be picked with fingerpicks 21 and a thumb pick 22, and chimed in the manner set forth in FIGS. 1-3.

Chimed arpeggios or notes of chords can be made, for example, not only in the conventional manner as by chiming open strings of a 5-string banjo in standard G-tuning at the fifth fret (G-chord) and seventh fret (D-chord) but also any other chord or chord position, for example, holding the fretting fingers in a C-chord by the nut and making a harmonic-rendering picking action with the picking hand as depicted in FIGS. 1-7 at the fourth string, seventh fret; third string, fifth fret; second string, sixth fret, and first string, seventh fret. Other chimed arpeggios of chord progressions can be made, for example, a G, C, D7 progression, by chiming open strings of a 5-string banjo in standard G-tuning by making a harmonic-rendering picking action with the picking hand as depicted in FIGS. 1-5 at the twelfth fret on the fourth, third, second, and/or first string(s); holding the fretting fingers in a C-chord by the nut and making a harmonic-rendering picking action with the picking hand as depicted in FIGS. 1-7 at the fourth string, fourteenth fret, the third string, twelfth fret, the second string, thirteenth fret, and/or the first string, fourteenth fret; and by holding the fretting fingers in a D7-chord by the nut and making a harmonic-rendering picking action with the picking hand as depicted in FIGS. 1-7 at the fourth string, twelfth fret, the third string, fourteenth fret, the second string, thirteenth fret, and/or the first string, twelfth fret. Such can make for simple back up arrangements. Compare, FIG. 8.

Chimed chords per se or parts of chords can be made, for instance, with the picking hand dampening two strings, say, for purposes of illustration, with a 5-string banjo in standard G-tuning making a harmonic-rendering picking action with the picking hand modified from that depicted in FIGS. 1-3 by simultaneously using the exposed fleshy part of the tip of the index finger of the picking hand at the third string, twelfth or fret, and the fleshy part of the tip of the ring finger of the picking hand at the second string, twelfth or thirteenth fret, and picking simultaneously picking with the thumb and little (pinky) finger of the picking hand on the third and second strings, while leaving the third and second strings open (G) or leaving the third string open and fretting the second string, first fret with a fretting finger of the non-picking hand (C). A part of a D-chord, D7-chord, or other chord is analogously made. Such chiming of multiple strings requires, however, a high level of coordination and dexterity on the part of the picking hand. On the other hand, a pinching action with two digits nearer the bridge on two separate strings coupled with the resting of respective fingertips on the nodes of strings can make a partial chord in harmonic tones quite readily. See, e.g., FIGS. 13 and 14.

In addition, chimed strings can be subjected to bending or choking to raise and/or lower the pitch of a chimed note made up the scale from the nut on the fingerboard, and the raised or lowered pitch is that of such a chime. Thus, for example, fretting with a fretting finger the third fret on the third string of a 5-string banjo or a guitar in standard tuning that is not capoed, and making a harmonic-rendering picking action with the picking hand such as depicted in FIGS. 1-7, say, about the fifteenth fret renders a chimed B-flat note one octave above the unchimed B-flat note; bending or choking the chimed string in the usual manner with the fretting finger but while the artificial harmonic chimes raises the tone of the string, which sounds in a harmonic tone based on the initially chimed B-flat note, which is then raised by choking the string. If the string is first bent or choked by the fretting finger, then chimed while it is bent, and the string is relaxed by the fretting finger toward the normal tension of the string while the chime still sounds, the tone of the chime is lowered. The same considerations apply when choking, de-choking or rendering vibrato on a string chimed up the neck, say, choking the second string of a 5-string banjo at the tenth fret while making a harmonic-rendering picking action as depicted in FIGS. 3-7 at the twenty-second fret. See, e.g., FIGS. 9 and 10. A vibrato with the fretting finger, either from side to side or up and down in relation to the fingerboard, while such a chimed note has been made, results in a vibrato chime. Also, a string chimed anywhere, whether fretted or not with a fretting finger or contacted along its length with a slide device or a fretted or fretless stringed instrument, can be stretched or relaxed by pulling or pushing on the neck in relation to the pot or body of the instrument if the instrument has such a configuration, by activating a tuning peg or cam such as a standard tuning peg or a Scruggs' tuner or Scruggs-Keith tuner and/or by activating a string-controlling pedal or lever as on a steel pedal guitar or an electric guitar equipped with such, say, as a "Wah-Wah" lever, and the instrument retains a chimed sound that increases or decreases in pitch with the tightening or loosening of the string that is chimed.

Moreover, a chimed note, typically made up the scale from the nut on the fingerboard, can be "slid" up or down the scale with a smooth slide 24 on a fretted or fretless instrument or with a finger pressing the string on the fingerboard of a fretless instrument, while retaining a chimed sound that increases and/or decreases in pitch. For example, using a brass or glass slide to contact the third string of a 5-string banjo, 6-string guitar or resophonic guitar in standard tuning at either the third or the eighth fret, respectively, and then making a harmonic-rendering picking action with the picking hand such as depicted in FIGS. 1-7, say, either at the fifteenth fret or at the twentieth fret, respectively, renders a chimed B-flat note one octave above the unchimed B-flat note or a chimed E-flat note one octave above the unchimed E-flat note, respectively. Sliding the slide up the neck progressively and smoothly raises the pitch of the chimed note, as a chime, and sliding the slide down the neck progressively and smoothly lowers the pitch of the chimed note, as a chime. See, e.g., FIGS. 11 and 12. Sliding a finger of the non-picking hand up or down the fingerboard of a fretless instrument such as a fretless banjo, violin, or upright bass while making such a chime on the pressed string makes a chimed, slid note also. That, however, is subject to often significant dampening, which may, moreover, be affected by characteristics of the particular instrument. When the fingerboard has frets, when sliding along them with the fretting digit in contact with the fingerboard, the sound of the chime typically is not heard; the same goes for hammering or pulling off notes that have been chimed. Rather in such cases, the unchimed tone is heard as the fretting finger passes over a fret or a hammer-on or pull-off is executed.

Of course, the use of a pick per se is not required. Note, FIGS. 13 and 14.

The way of chiming set forth in FIGS. 1-14 is adaptable to and interchangeable among many instruments. Thus, for example, banjos, guitars, mandolins and so forth and the like may be chimed in such a manner or in a similar manner.

Figure 15:
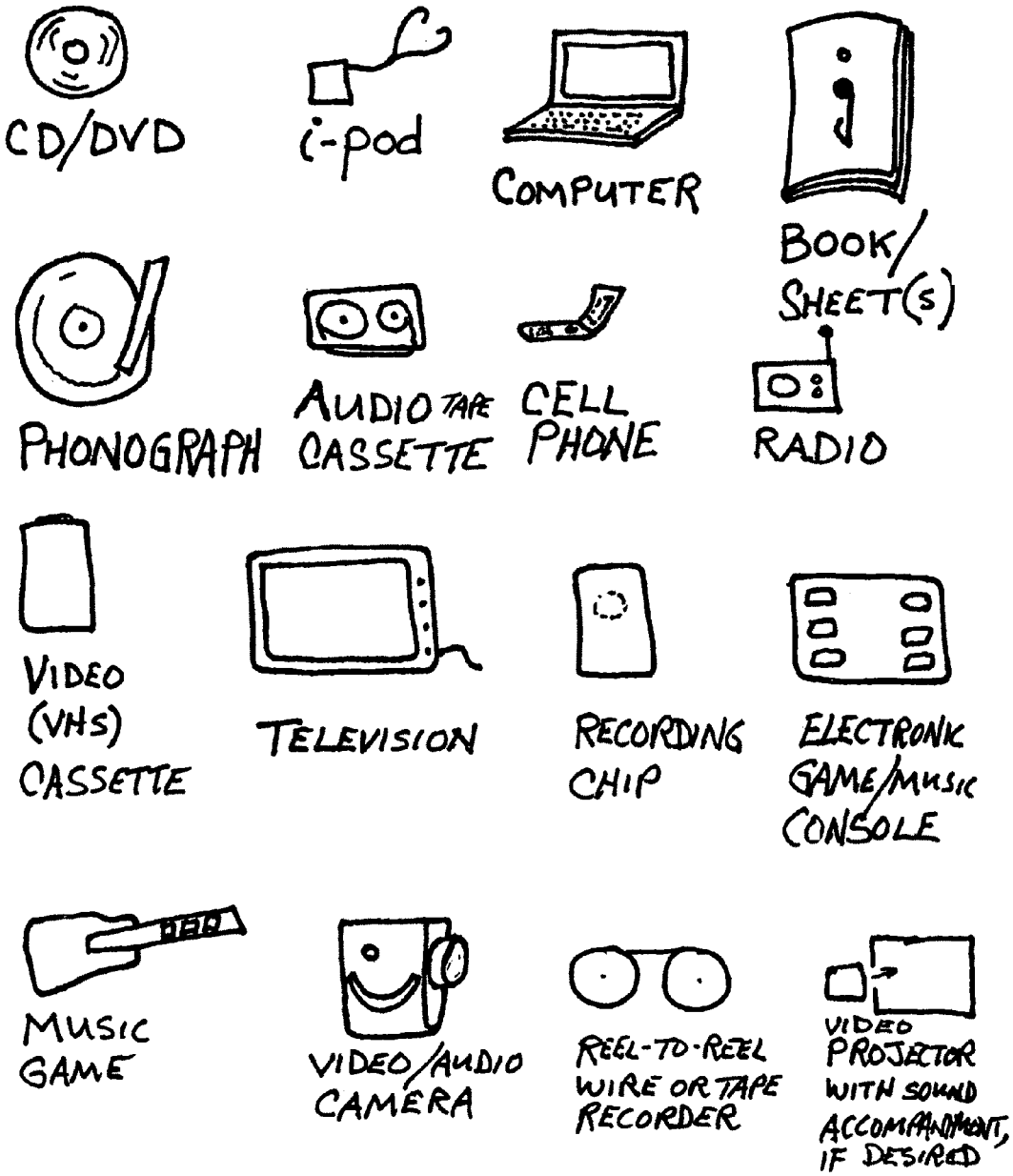

FIG. 15 depicts some tangible media of expression with which the present harmonics can be recorded or otherwise fixed. From such and/or the disclosures of the present specification, and so forth and the like, playing, performing, distributing, reading and/or instructing of the harmonics may be carried out. Instructing can involve, for example, conveying information, observing and/or evaluating understanding and/or performance, making adjustment(s) and/or correction(s) as may be necessary or desirable, and so forth. Iterations of such steps may be carried out. An instructor may assist or provide instruction to a student. There may be self-instruction.

The present invention is thus provided. Various feature(s), step(s), part(s), subcombination(s) and/or combination(s) may be employed with or without reference to other feature(s), step(s), part(s), subcombination(s) and/or combination(s) in the practice of the invention, and numerous adaptations and modifications can be effected within its spirit, the literal claim scope of which is particularly pointed out as follows:

I claim:

1. A method for a player to render a harmonic chime on a stringed instrument that has a neck, a bridge, and at least one string, wherein the player has a string-stopping hand that can shorten a playable length of the at least one string plus a string-picking hand with a plurality of digits including a thumb and fingers, the thumb and a finger of which can hold, or the thumb itself able to have mounted thereon, a first pick, which comprises: providing the stringed instrument; holding by the thumb and finger of the string-picking hand, or mounting on the thumb of the string-picking hand, the first pick; and touching a second pick mounted on another finger of the string-picking hand, or touching another finger of the string-picking hand not having a pick, to a harmonic-rendering node position of the at least one string, and plucking the at least one string between the bridge and the harmonic-rendering node position with the first pick to provide the harmonic chime.

2. The method of claim 1, wherein the first pick is held by digits of the string-plucking hand that include thumb and index finger.

3. The method of claim 1, wherein the string-plucking hand has two fingerpicks respectively mounted on two fingers, and a thumb pick mounted on the thumb; and a finger of the player's hand not having a pick touches the string along a harmonic-rendering node position of the at least one string.

4. The method of claim 1, wherein recording in a tangible medium of expression is carried out.

5. The method of claim 4, wherein the tangible medium of expression includes at least one of a book or sheets; a CD; a DVD; a computer; and a recording chip.

6. The method of claim 5, wherein instruction is provided.

7. The method of claim 3, wherein the stringed instrument is a 5-string banjo.

8. The method of claim 4, wherein the stringed instrument is a 5-string banjo.

9. The method of claim 5, wherein the stringed instrument is a 5-string banjo.

10. The method of claim 6, wherein the stringed instrument is a 5-string banjo.

11. In a method of rendering a harmonic chime on a string of a 5-string banjo having a bridge by a player, wherein the player has a picking hand having a thumb and at least three fingers in addition to the thumb, and wears a thumb pick on the thumb and two fingerpicks respectively on index and middle fingers for picking strings of the banjo, the improvement which comprises plucking the string between the bridge and a harmonic-rendering node position with the thumb pick while touching the string with a finger from among the at least three fingers of the picking hand, and lifting the finger upon plucking the string with the thumb to provide the harmonic chime.

12. The method of claim 11, wherein the finger from among the at least three fingers of the picking hand is a ring finger on which there is mounted no fingerpick.

13. The method of claim 11, wherein an artificial harmonic tone is rendered.

14. The method of claim 13, wherein an artificial harmonic tone is "bent," "choked," subject to "vibrato" choking, and/or "slid" up and/or down scale.

15. An article of manufacture comprising a tangible medium of expression in or on which a harmonic chime tone is recorded, which is rendered by a method for a player to render a harmonic chime on a stringed instrument that has a neck, a bridge, and at least one string, wherein the player has a string-stopping hand that can shorten a playable length of the at least one string plus a string-picking hand with a plurality of digits including a thumb and fingers, the thumb and a finger of which can hold, or the thumb itself able to have mounted thereon, a first pick, which comprises: providing the stringed instrument; holding by the thumb and finger of the string-picking hand, or mounting on the thumb of the string-picking hand, the first pick; and touching a second mounted on another finger of the string-picking hand, or touching another finger of the string-picking hand not having a pick, to a harmonic-rendering node position of the at least one string, and plucking the at least one string between the bridge and the harmonic-rendering node position with the first pick to provide the harmonic chime.

16. The tangible medium of expression of claim 15, wherein an artificial harmonic tone is rendered, and the first pick is held by digits of the second hand that include thumb and index finger.

17. The tangible medium of expression of claim 15, wherein the string-plucking hand has two fingerpicks respectively mounted on two fingers, and a thumb pick mounted on the thumb; and a finger of the player's hand not having a pick touches the string along a harmonic-rendering node position of the at least one string.

18. The tangible medium of expression of claim 17, which includes at least one of a book or sheets; a CD; a DVD; a computer; and a recording chip.

19. The tangible medium of expression of claim 18, wherein instruction is provided.

20. The tangible medium of expression of claim 19, wherein the stringed instrument is a 5-string banjo.

* * * * *